United States Patent [19]

Katoh

[11] Patent Number: 4,987,449

[45] Date of Patent: Jan. 22, 1991

[54] METHOD OF SENSING A REMAINING AMOUNT OF DEVELOPER FOR A COLOR IMAGE FORMING APPARATUS

[75] Inventor: Shunji Katoh, Sagamihara, Japan

[73] Assignee: Ricoh Company, Ltd., Tokyo, Japan

[21] Appl. No.: 444,858

[22] Filed: Dec. 4, 1989

[30] Foreign Application Priority Data

Dec. 5, 1988 [JP] Japan ..... 63-306064

[51] Int. Cl.[5] ..... G03G 21/00

[52] U.S. Cl. ..... 355/206; 118/688; 118/690; 355/209; 355/245; 355/326

[58] Field of Search ..... 355/206, 207, 246, 245, 355/326, 327, 208; 118/688, 690

[56] References Cited

U.S. PATENT DOCUMENTS 4,032,227 6/1977 Hubbard et al. ..... 355/206
4,626,096 12/1986 Ohtsuka et al. ..... 355/209
4,666,290 5/1987 Yoshiura ..... 355/209
4,669,856 6/1987 Yamada ..... 355/209

*Primary Examiner*—A. T. Grimley
*Assistant Examiner*—Thu Dang
*Attorney, Agent, or Firm*—Oblon, Spivak, McClelland, Maier & Neustadt

[57] ABSTRACT

A remaining developer sensing method for an image forming apparatus operable with a plurality of replaceable developing units each storing a developer of different color maintains the amounts of developers of remaining in the individual developing units equal to each other at all times. An exclusive sensor responsive to the remaining amount of toner is mounted on the bottom of a toner hopper of each developing unit and outputs a toner absence signal when the amount of toner remaining in the associated developing unit becomes short. When the toner absence signal continuously appears over a predetermined period time, the operation of the apparatus is inhibited. The predetermined period time differs from one developing unit to another.

7 Claims, 3 Drawing Sheets

METHOD OF SENSING A REMAINING AMOUNT OF DEVELOPER FOR A COLOR IMAGE FORMING APPARATUS

BACKGROUND OF THE INVENTION

The present invention relates to a color image forming apparatus of the type operable with a plurality of replaceable developing units each storing a developer of different color and, more particularly, to a remaining developer sensing method for such a color image forming apparatus which maintains the amounts of developers remaining in the individual developing units equal to each other at all times.

An electrophotographic copier, facsimile machine, laser printer or similar image forming apparatus has a developing unit which is often loaded with a two-component developer, i.e. a mixture of toner and carrier. In this kind of developing unit, the toner contained in the developer is sequentially consumed as the development is repeated and, hence, the amount of developer remaining in the developing unit is reduced little by little. It is a common practice to sense the remaining amount of developer every time the development is repeated a predetermined number of times and, when the sensed amount is smaller than a certain reference value, to supply a fresh developer to the developing unit. The remaining amount of toner may be sensed in terms of a load acting on an agitator which is disposed in a toner hopper of the developing unit or in terms of a pressure acting on a piezoelectric sensor which is mounted on the inner wall of the toner hopper, as proposed in the past.

A color image forming apparatus operable with a plurality of replaceable developing units each accommodating a developer of different color is extensively used. With this type of apparatus, too, it is necessary to sense the amounts of developers remaining in the individual developing units. It has been customary with such a color image forming apparatus to sense the amounts of developers remaining in the individual developing units under identical sensing conditions and at the same timing, i.e., without changing them from one color to another. This, however, fails to allow an equal amount of toner to remain in the toner hoppers of all of the developing units, inasmuch as the characteristics, especially the fluidity, differs from a developer or toner of one color to a developer or toner of another color. Specifically, assume that the amount of developer containing a toner of particular color which is consumed at a higher rate than the other toners is sensed under identical conditions with the other developers. Then, even when the toner of the particular color becomes scarce in the developer, a toner near-end condition, toner end condition or similar toner shortage condition will not be detected immediately. Should the amount of supply of the developer, i.e., fresh toner be lowered, the density of an image developed by the toner would become poor while the proportion of the toner to the carrier would decrease. The carrier eventually increased in concentration relative to the toner is apt to deposit on various component parts such as a photoconductive drum which is an image carrier for forming a latent image thereon.

SUMMARY OF THE INVENTION

It is therefore an object of the present invention to provide a remaining developer sensing method for a color image forming apparatus which maintains the amounts of developers remaining in the toner hoppers of all of the developing units each storing a developer of different color equal to each other at all times.

It is another object of the present invention to provide a generally improved method of sensing a remaining amount of developer for a color image forming apparatus.

In an image forming apparatus operable with a plurality of replaceable developing units each storing a developer of different color for forming a plurality of color images, a method of sensing a remaining amount of developer in each of the developing units comprises the steps of mounting one of the developing units on the image forming apparatus, identifying a color of the developer stored in the one developing unit, and sensing a remaining amount of the developer under a sensing condition particular to the identified color of the developer.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
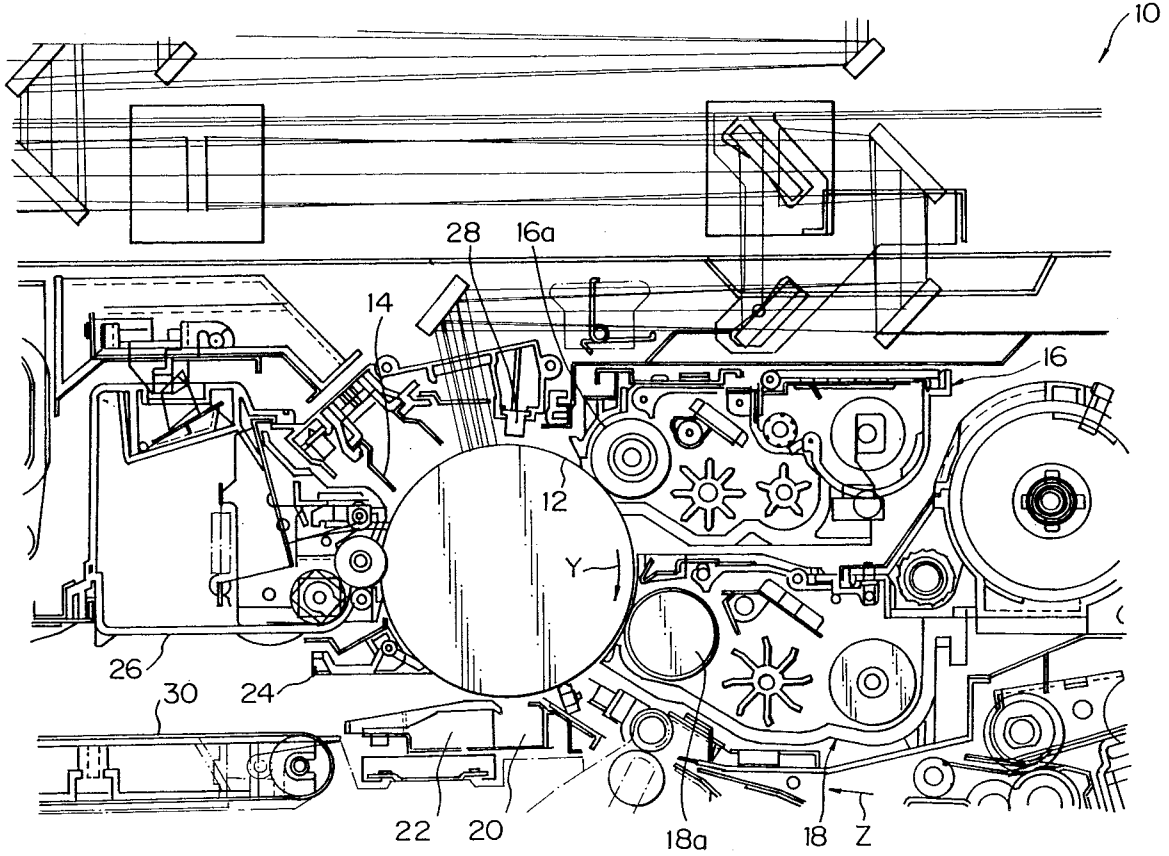
FIG. 1 is a fragmentary elevation of a color image forming apparatus to which a method of the present invention is applicable.

Referring to FIG. 1 of the drawings, a color image forming apparatus to which a preferred embodiment of the present invention is applied is shown and generally designated by the reference numeral 10. As shown, the apparatus 10 has an image carrier in the form of a photoconductive drum 12. Arranged around the drum 12 are a main charger 14, a color developing unit 16 having a developing roller **16*a*, a black developing unit 18 having a developing roller 18*a*, a transfer charger 20, a separation charger 22, a toner density sensor 24, and a cleaning unit 26. An eraser 28 is located downstream of and in close proximity to the main charger 14 for dissipating a charge deposited in non-image regions. The reference numeral 30** designates a transport belt.

Figure 2:
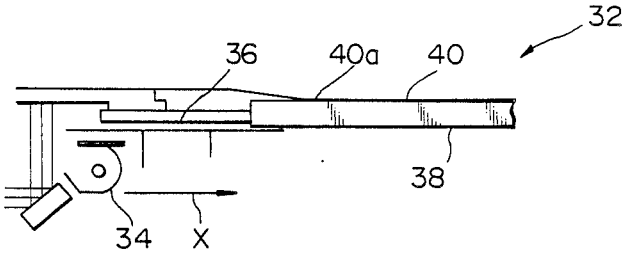
FIG. 2 is a schematic view of an illuminating device installed in the apparatus of FIG. 1.

FIG. 2 shows an illuminating device included in the color image forming apparatus 10. The illuminating device, generally 32, has a light source 34, and a reference density plate 36 having a reference density. The reference numeral 38 designates a glass platen on which an original document 40 having a leading edge **40*a*** is laid.

In operation, light issuing from the light source 34 scans the document 40 on the glass platen 28 in a direction indicated by an arrow X in the FIG. 2. A reflection from the document 40 is steered by optics which includes mirrors and a lens as shown in FIG. 1 onto the drum 12. At this instant, the drum 12 has been uniformly charged to a predetermined polarity by the main charger 14 and is rotating in a direction Y in synchronism with the scanning operation of the light source 34. Consequently, a latent image representative of the document 40 is electrostatically formed on the drum 12. The latent image is developed by one of the color developing unit 16 and black developing unit 18, i.e., by a toner of particular color stored therein. The resulting toner image is transferred by the transfer charger 20 to a paper sheet which is fed to the drum 12 in a direction indicated by an arrow Z. The paper sheet carrying the toner image thereon is separated from the drum 12 by the separation charger 22, then transported by the belt 30 to a fixing unit (not shown) to fix the toner image, and then driven out of the image forming apparatus 10.

The toners stored in the individual developing units 16 and 18 are selectively fed to the drum 12 and, therefore, sequentially consumed. The toner density sensor 24 senses the density of a toner image formed on the drum 12 and sequentially lowered due to such consumption of toner. When the toner density is lowered, the image density is controlled by increasing the amount of toner in the developer, for example. Specifically, the reference density plate 36 is scanned beforehand to form an electrostatic latent image thereof on the drum 12. After this latent image has been developed to form a toner image, the toner density sensor 24 senses the density of the toner image. When the output of the toner density sensor 24 exceeds a predetermined reference level, a toner supply roller 46 (FIG. 3) of the developing unit 16 or 18 is driven a predetermined number of times or for a predetermined period of time to supply the associated toner to the developing roller 16*a* or 18*a* with the toner density being determined to have decreased. In this manner, the toner concentration in the developer and, therefore, the image density is controlled.

Figure 3:
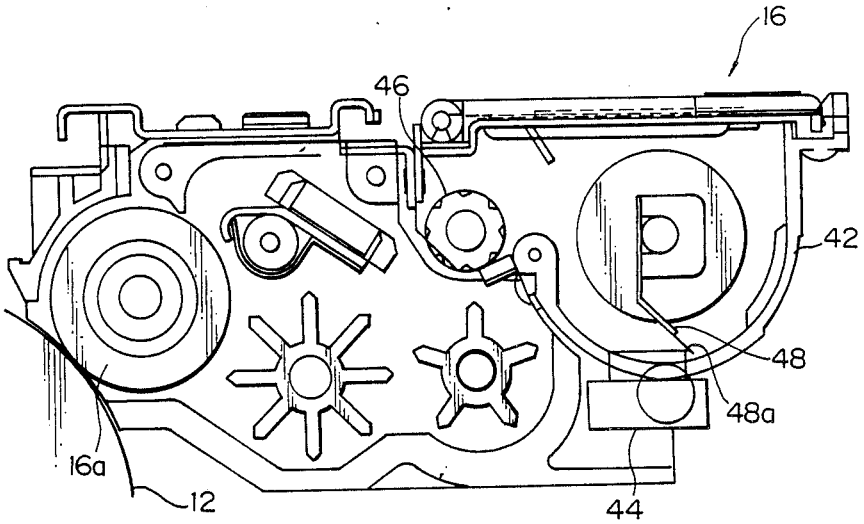
FIG. 3 is an enlarged view of a developing unit included in the apparatus of FIG. 1.

The amounts of developers remaining in the developing units 16 and 18 are sensed, as follows. As regards the black developing unit 18, the toner density sensor 24 senses the density of a toner image on the drum 12 a predetermined number of times. When a mean value of the sensed densities of toner images is lowered beyond a predetermined density, it is determined that the amount of developer remaining in the developing unit 18 is short, i.e., a toner near-end condition has been reached. Then, an indicator provided on an operation board (not shown) of the apparatus 10 is turned on in a flashing mode in order to urge the user to supply the developer or to replace a toner cartridge. As a predetermined number of extra copies are produced thereafter, the indicator is switched over to a glowing mode with the operation of the apparatus 10 being inhibited. As shown in FIG. 3, the color developing unit 16 has a toner hopper 42 and an exclusive sensor 44 which is mounted on the bottom of the toner hopper 42 for sensing the remaining amount of toner. When the amount of toner remaining in the toner hopper 42 is scarce, the sensor 44 senses a toner near-end condition, i.e., it determines that the remaining amount of developer is short. Then, an indicator provided on the operation board is turned on in a flashing mode. After a predetermined number of extra copies have been produced thereafter, the indicator is switched over to a glowing mode to inhibit any further copying operations. The toner sensor 44 produces a toner presence signal (5 volts) when the remaining amount of toner is greater than a predetermined amount and a toner absence signal (0 volt) when otherwise. The toner sensor 44 is constantly cleaned by a flexible member 48*a* which is affixed to the free end of an agitator 48.

Figure 4:
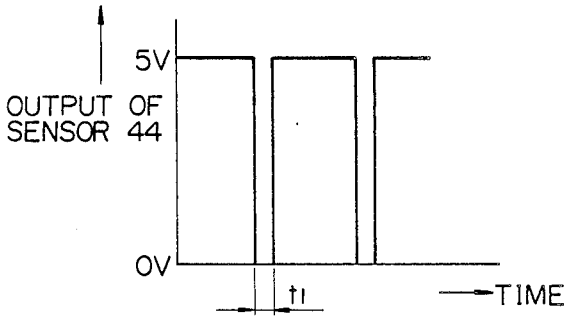
FIG. 4 is a diagram showing an output waveform of a sensor.
Figure 5:
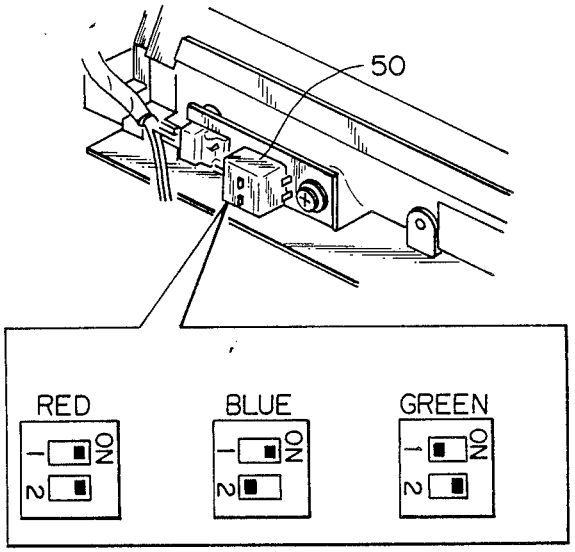
FIG. 5 is a view showing a specific form of means for distinguishing independent developing units.

As shown in FIG. 4, when the toner absence signal (0 volt) continuously appears for a predetermined period of time $t_1$, it is determined that a toner near-end condition has been reached, i.e., that the remaining amount of toner is short. The duration $t_1$, however, is noticeably effected by the fluidity of a toner used, i.e., the toner near-end condition will not be detected until the hopper 42 becomes empty if the toner has high fluidity. In the light of this, the illustrative embodiment changes the threshold value of the period of time $t_1$ from one developer to another. Specifically, the fluidity of a developer depends on the pigment and whether or not an additive is contained. Since a blue developer has the highest fluidity as generally accepted, the period of time $t_1$ associated therewith is selected to be about 0.5 second by taking account of the time necessary for the toner to drop onto the sensor 44 after the passage of the agitator. As for a red toner whose fluidity is lowest, the period of time $t_1$ is selected to be about 1 second. FIG. 5 shows a specific form of means for discriminating developers of different colors. In FIG. 5, a read switch 50 serving as such means is capable of distinguishing up to four different colors based on 2-bit data.

In summary, it will be seen that the present invention is successful in allowing developing units each storing a developer of different color to have an identical amount of toner remaining therein at all times and, therefore, in producing images in stable density with no regard to the color.

Various modifications will become possible for those skilled in the art after receiving the teachings of the present disclosure without departing from the scope thereof.

What is claimed is:

1. In an image forming apparatus operable with a plurality of replaceable developing units each storing a developer of different color for forming a plurality of color images, a method of sensing a remaining amount of developer in each of said developing units, comprising the steps of:

(a) mounting one of said developing units on said image forming apparatus;

(b) identifying a color of the developer stored in said one developing unit; and (c) sensing a remaining amount of said developer under a sensing condition particular to a consumption rate of said identified color of said developer.

2. A method as claimed in claim 1, wherein step (c) comprises:

(d) providing a sensor responsive to an amount of toner remaining in said developer which is stored in said one developing unit;

(e) detecting a duration of a toner absence signal which is outputted by said sensor; and (f) determining, when said detected duration is longer than a predetermined duration particular to said consumption rate of said identified color, that the remaining amount of said developer is short.

3. A method as claimed in claim 2, further comprising the steps of providing an indication that the remaining amount of said developer is short.

4. In an image forming apparatus operable with a plurality of replaceable developing units each storing a developer of different color for forming a plurality of color images, each developer having a fluidity, a method of sensing a remaining amount of developer in each of said developing units, comprising the steps of:

(a) mounting one of said developing units on said image forming apparatus;

(b) identifying a color of the developer stored in said one developing unit;

(c) providing a sensor responsive to an amount of toner remaining in said developer which is stored in said one developing unit;

(d) detecting a duration of a toner absence signal which is outputted by said sensor; and (e) determining, when said detected duration is longer than a predetermined duration particular to the fluidity of said identified color of the developer, that the remaining amount of said developer is short.

5. A method as claimed in claim 4, wherein said predetermined duration particular to a color of the developer having high fluidity is short, and said predetermined duration particular to a color of the developer having low fluidity is long.

6. A method as claimed in claim 5, wherein said predetermined duration particular to a blue developer is shorter than that particular to a red developer.

7. A method as claimed in claim 4, wherein each of said developer units comprises an agitator with a flexible member, said sensor being constantly cleaned by the flexible member of said agitator.

* * * * *